US011479932B2

(12) United States Patent
Patel

(10) Patent No.: US 11,479,932 B2
(45) Date of Patent: Oct. 25, 2022

(54) SYSTEM AND METHOD FOR ANCHORING BOLLARDS AND CURBSIDE FEATURES

(71) Applicant: Niraj Patel, Rockville, MD (US)

(72) Inventor: Niraj Patel, Rockville, MD (US)

( * ) Notice: Subject to any disclaimer, the term of this patent is extended or adjusted under 35 U.S.C. 154(b) by 168 days.

(21) Appl. No.: 16/689,840

(22) Filed: Nov. 20, 2019

(65) Prior Publication Data

US 2021/0148070 A1 May 20, 2021

(51) Int. Cl.
*E01F 9/681* (2016.01)

(52) U.S. Cl.
CPC ..... *E01F 9/681* (2016.02)

(58) Field of Classification Search
CPC . E01F 9/658; E01F 9/669; E01F 9/673; E01F 9/681
USPC ..... 248/530
See application file for complete search history.

(56) References Cited

U.S. PATENT DOCUMENTS 3,034,287 A * 5/1962 Odom ..... G07F 17/246 368/6
4,594,157 A * 6/1986 McGowan ..... E03F 5/06 210/163
5,020,103 A * 5/1991 Holland ..... E04H 1/14 379/451
5,150,982 A * 9/1992 Gilb ..... E04F 11/1812 403/232.1
5,301,229 A * 4/1994 Raynor ..... H04M 17/026 379/143
6,065,900 A * 5/2000 Reale ..... E01F 13/00 404/6
7,607,856 B2 * 10/2009 Patel ..... E01F 15/003 404/6
8,277,143 B2 * 10/2012 Adler ..... E01F 9/685 404/6
2003/0223807 A1 * 12/2003 Lanphier ..... E04F 11/1812 403/167
2004/0265055 A1 * 12/2004 Zivkovic ..... E01F 9/642 404/6
2007/0086858 A1 * 4/2007 Morgan ..... E01F 13/12 404/6
2008/0112756 A1 * 5/2008 Omar ..... E01F 13/12 404/9
2009/0035061 A1 * 2/2009 Crawford ..... E01F 13/12 404/6
2011/0033232 A1 * 2/2011 Adler ..... E01F 9/685 404/6

* cited by examiner

*Primary Examiner* — William V Gilbert

(57) ABSTRACT

A system and method for anchoring bollards and curbside features is disclosed. The 'curb apparatus' is comprised of a planar, horizontal plate and a vertical portion on a distal end with apertures to receive a plurality of fasteners. This L-shaped, curb apparatus is selectively affixed to street curbs. An object of the invention is to support curbside features such as lighting bollards, benches, and bike racks etc. For example, in one embodiment, the feet of a park bench are affixed to the horizontal plate of the curb apparatus and the vertical portion is bolted into the vertical wall of the curb and gutter in a street. Other embodiments incorporate gussets and stiffeners to prevent bending and shifting as well as other means of fastening such as cements and epoxies. This installation prevents the bench from shifting when bumped and can mitigate vandalism.

2 Claims, 5 Drawing Sheets

SYSTEM AND METHOD FOR ANCHORING BOLLARDS AND CURBSIDE FEATURES

FIELD OF THE INVENTION

The present invention generally relates to anchoring systems. More specifically, it relates to a curbside anchoring system for temporary and permanent bollard, barriers and street furniture.

BACKGROUND

A bollard is a sturdy, short, vertical post. In the 18th centuries, old cannons were often used as bollards on quaysides to help moor ships at dock. The cannons would be buried in the ground muzzle-first to approximately half or two-thirds of their length, leaving the breech (rear end) projecting above ground for attaching ropes. Today, bollards can be seen in streets in most cities and are used to control traffic intake size by limiting movements, or to control traffic speed by narrowing the available road space. Other bollards are used to protect public spaces, buildings, and the people in them from car ramming attacks. They usually consist of a simple, steel post anchored to concrete, cored into a hard surface, buried in the ground or secured on a self-locking taper or impact-recovery system to protect the surrounding foundations when a bollard is struck. As concerns over ramming attacks continue to increase, the safety industry has begun developing adaptive bollards systems for public spaces and streets. United States Patent No. US20090035061A1 granted to John Edwin Crawford, Chunlin Liu, and Vicky Jakoby disclosed a removable bollard system; however, it does not leverage the strength of curbs for support. United States Patent No. US20040265055A1 granted to Gradimir Zivkovic disclosed a pivoting bollard; however, it is a permanent, form fixture. U.S. Pat. No. 6,065,900A granted to George Reale disclosed a collapsible bollard system; however, it does not leverage the support of curbs to further support the bollard. U.S. Pat. No. 8,277,143B2 granted to Richard S. Adler and John Crawford teach of a modular, bollard, anti-ram system that affixes to curbs; however, does not use the curb elevation for support nor it does accommodate other street features.

SUMMARY OF THE INVENTION

The device herein disclosed and described provides a solution to the shortcomings in the prior art through the disclosure of a curb apparatus for anchoring bollards and curbside, street features. An object of the invention is to support existing street features such as signs, bollards etc. The curb apparatus is made of a thick metal and is wrapped around an existing street gutter curb. Should a vehicle come in contact with a street fixture anchored to the system, the vertical and horizontal loads will be transmitted to the curb thereby minimizing damage to the fixture and intrusion/penetration of the vehicle into public area that are being protected by the fixture.

Another object of the curb apparatus is to provide modularity for curb-side anchors. Embodiments of the invention can include plates of various sizes and angles to accommodate a multitude of street fixtures with single or multiple attachment points, such as those found on signs poles and benches respectively.

Another object of the curb apparatus is to provide retrofit capabilities. The apparatus can be selectively bolted or adhered onto a plurality of curb types such as filleted cement and square granite curbs. For temporary street events, the entire system or parts of the system can be removed when an event is finished.

Another object of the curb apparatus invention is to provide a curb-based anchoring system that does not interfere with street gutter operations. Water runoff passing over the apparatus is minimally impacted when affixed to a curb gutter.

Another object of the curb apparatus is to provide anchoring options. While some embodiments have apertures for bolt connections, other embodiments do not and can allow for the use of adhesives. Yet other embodiments do not need any adhesive and instead rely on the weight of the apparatus to secure a street fixture.

It is briefly noted that upon a reading this disclosure, those skilled in the art will recognize various means for carrying out these intended features of the invention. As such it is to be understood that other methods, applications and systems adapted to the task may be configured to carry out these features and are therefore considered to be within the scope and intent of the present invention, and are anticipated. With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention. As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF THE FIGURES

The accompanying drawings, which are incorporated herein and form a part of the specification, illustrate some, but not the only or exclusive, examples of embodiments and/or features.

Figure 1:
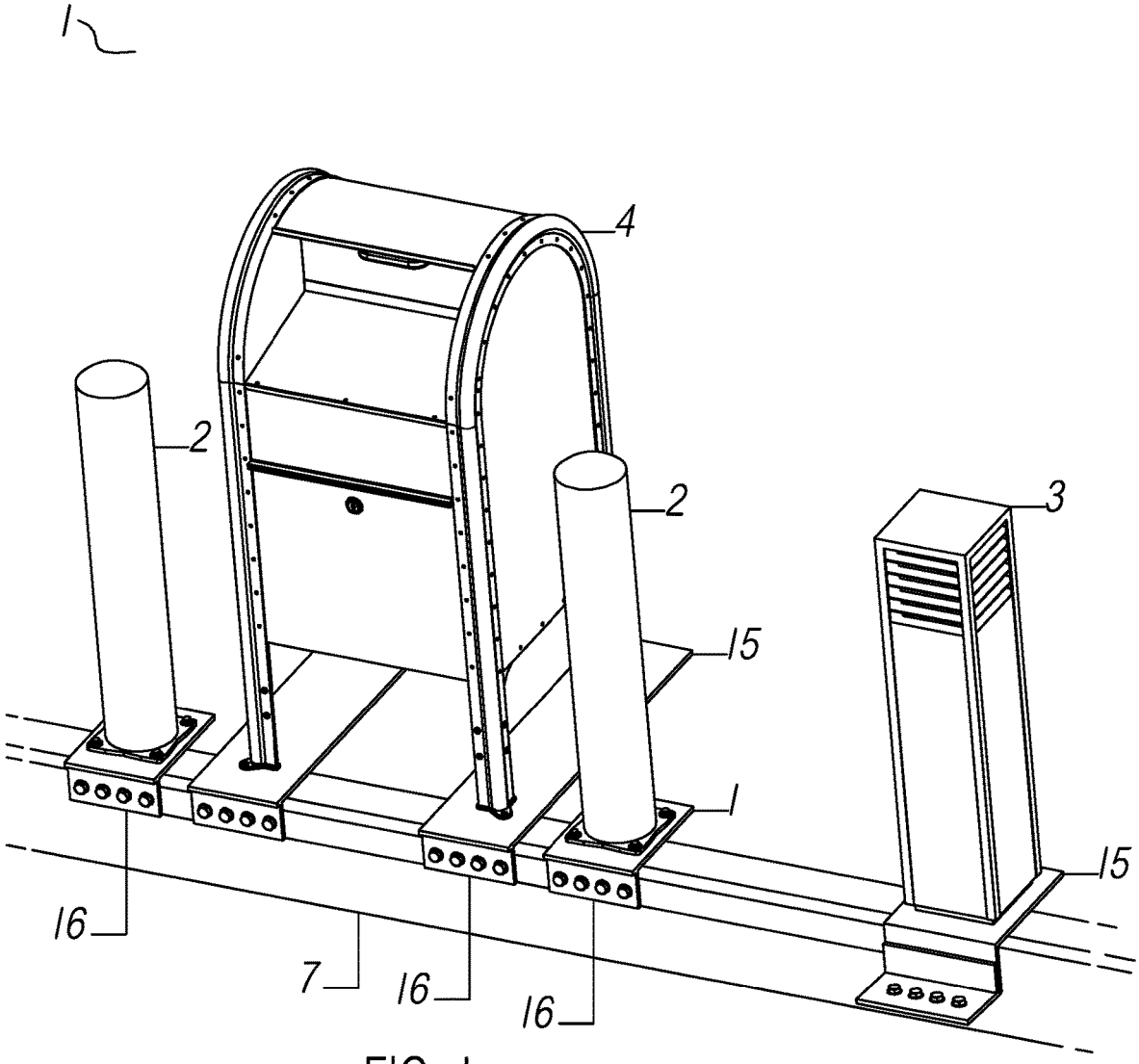
FIG. 1 shows a perspective view of the curb apparatus on mail drops and bollards.

Other aspects of the present invention shall be more readily understood when considered in conjunction with the accompanying drawings, and the following detailed description, neither of which should be considered limiting.

DETAILED DESCRIPTION OF FIGURES

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation. Conventional components of the invention are elements that are well-known in the prior art and will not be discussed in detail for this disclosure.

Figure 2:
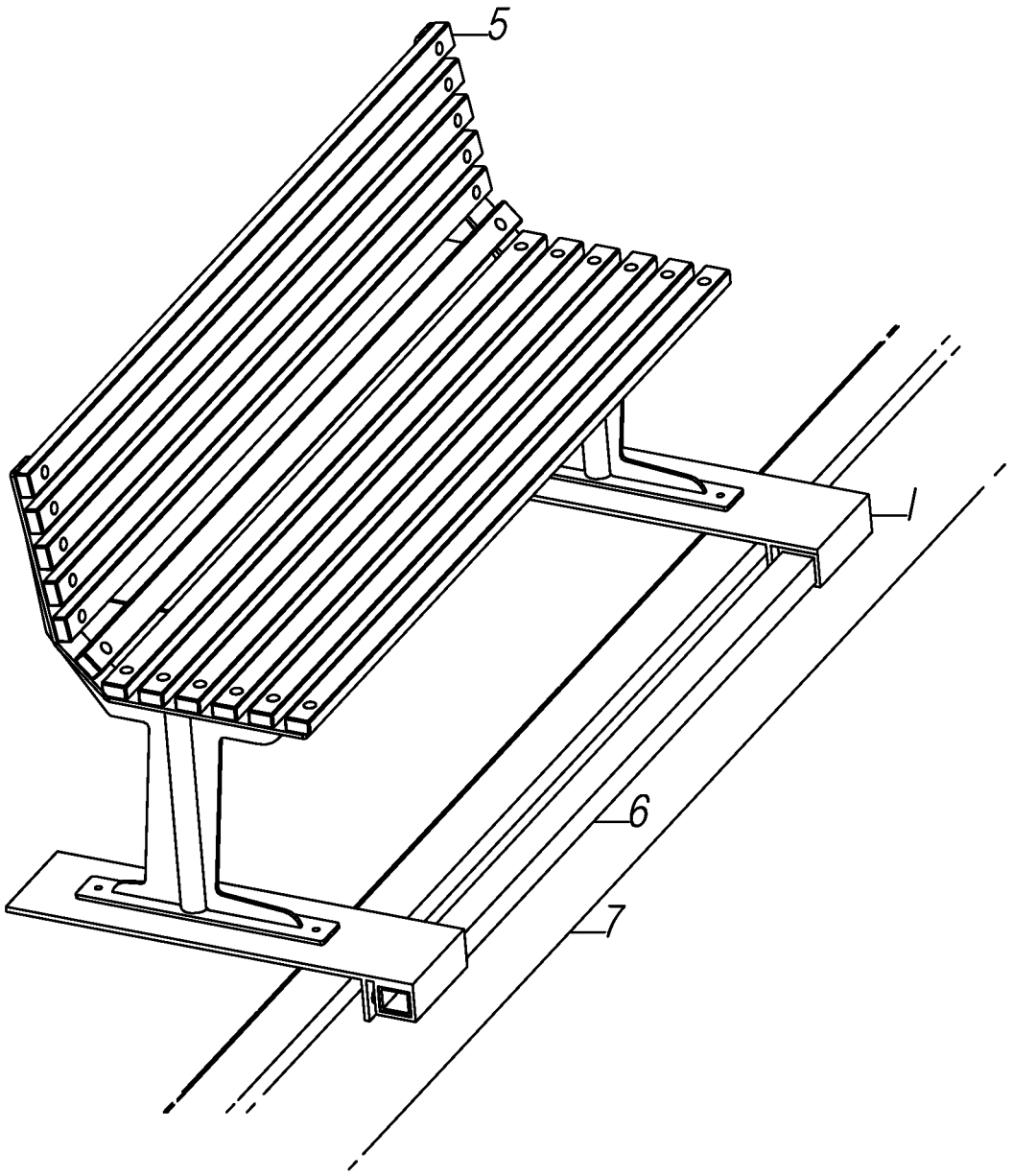
FIG. 2 shows a perspective view of a rail embodiment of the curb apparatus.
Figure 3:
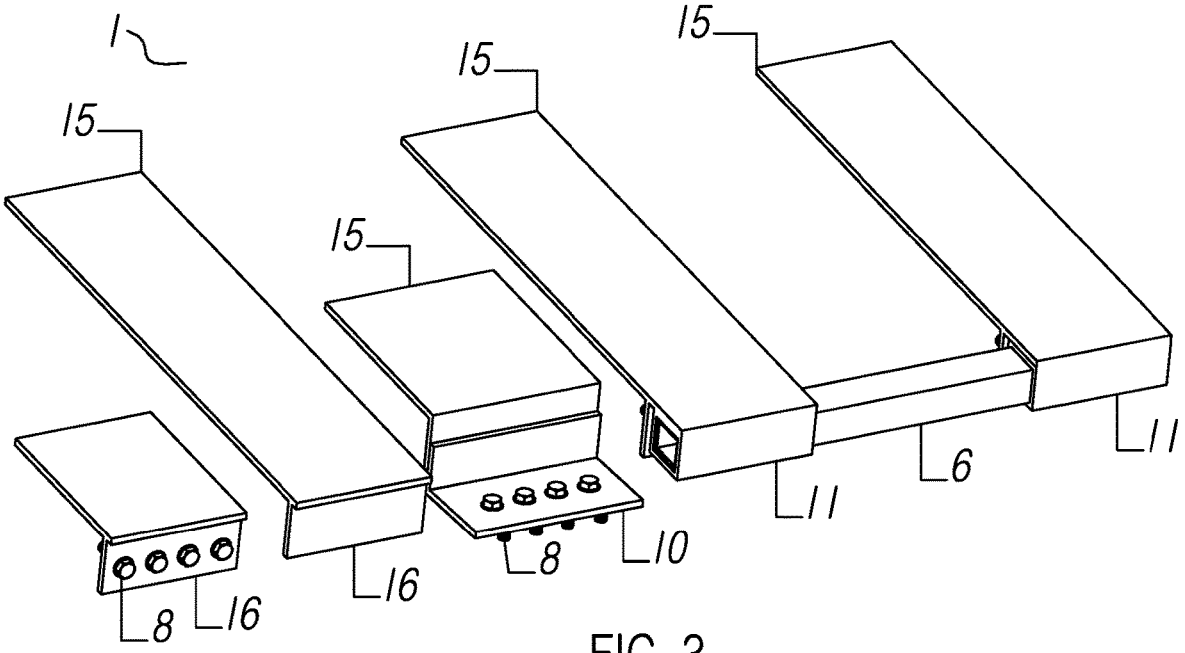
FIG. 3 shows a top perspective view various embodiments of the curb apparatus.
Figure 4:
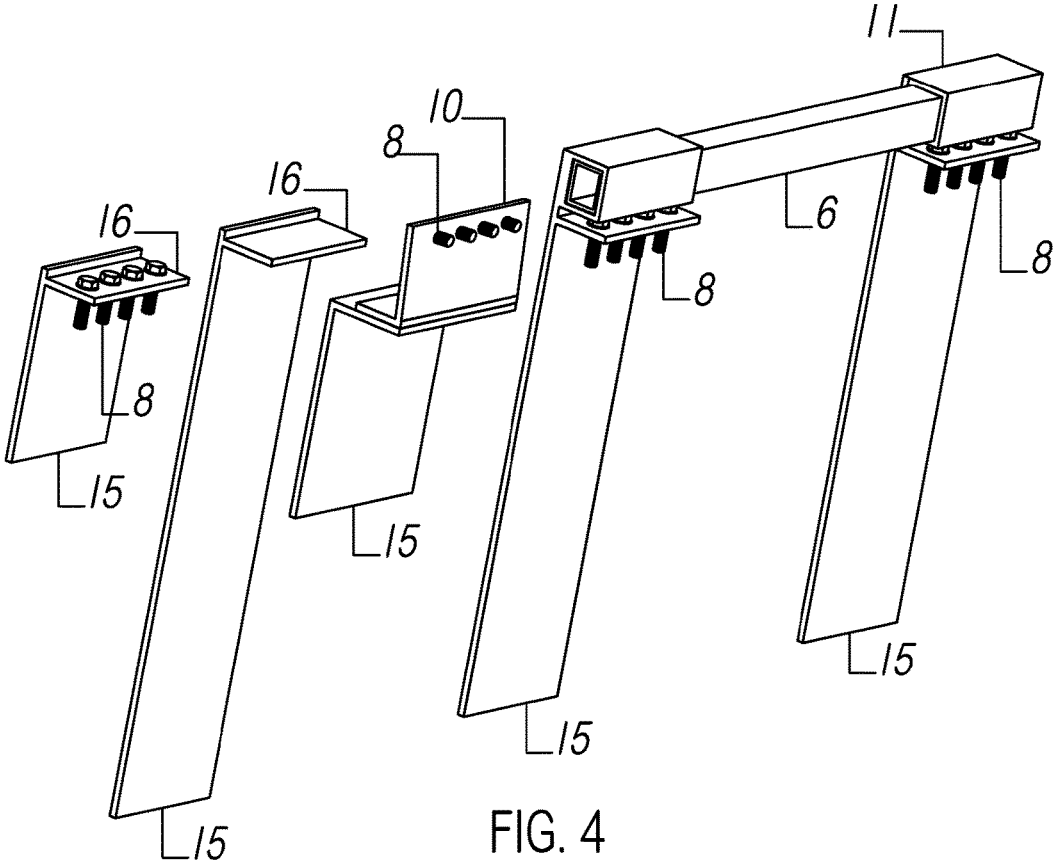
FIG. 4 shows a bottom perspective view various embodiments of the curb apparatus.
Figure 5:
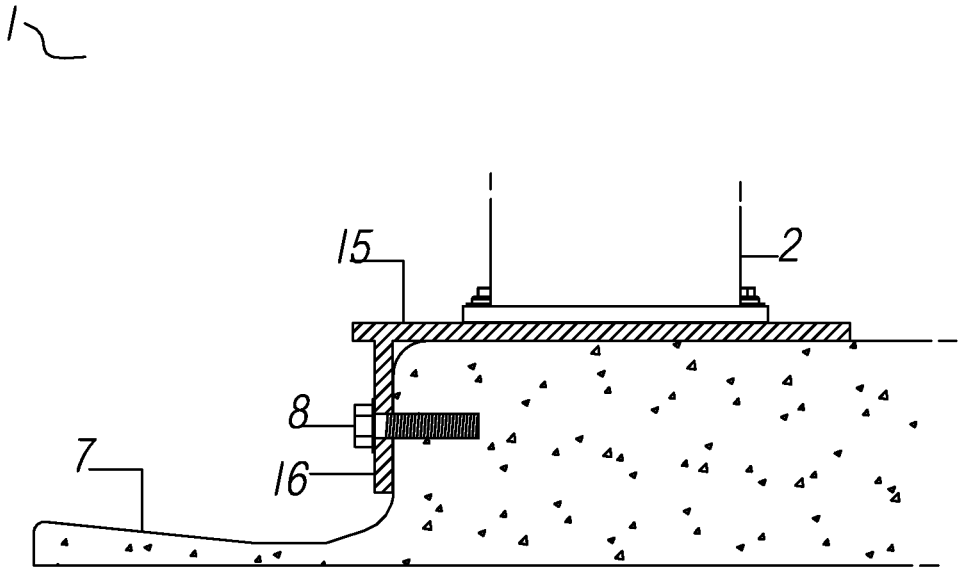
FIG. 5 shows a section view of the curb apparatus affixed with bolts.
Figure 6:
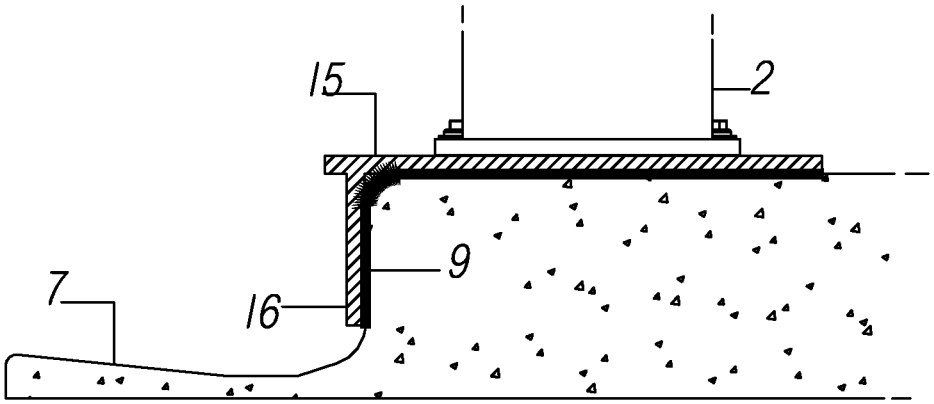
FIG. 6 shows a section view of the curb apparatus affixed with adhesive.
Figure 7:
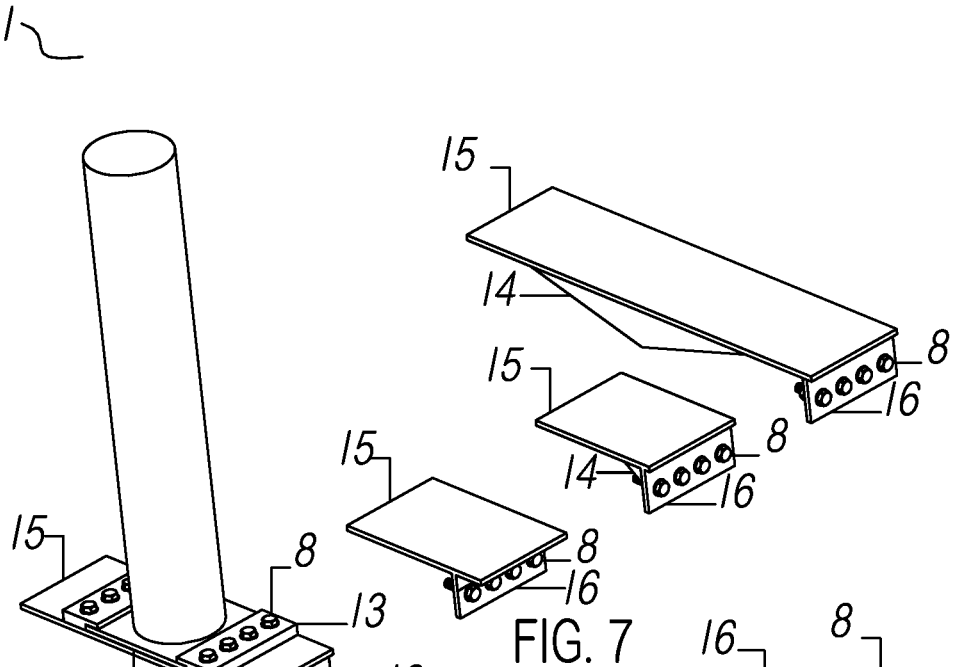
FIG. 7 shows a top perspective view various embodiments of the curb apparatus.
Figure 8:
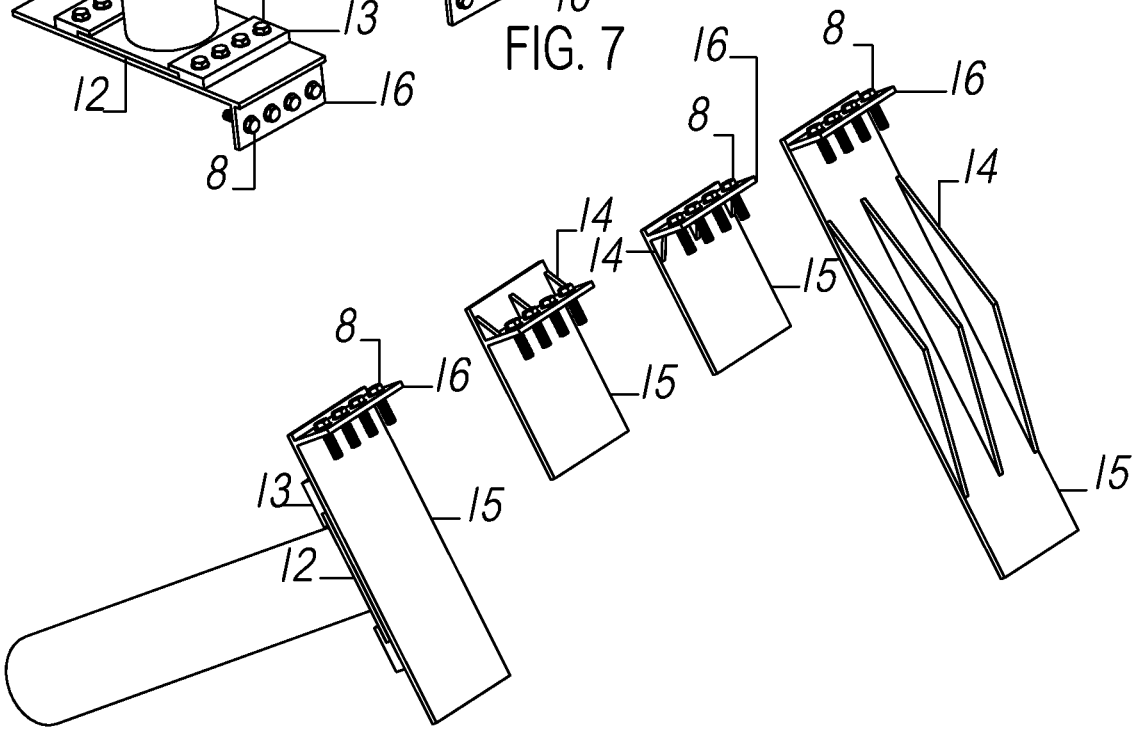
FIG. 8 shows a bottom perspective view various embodiments of the curb apparatus.

FIGS. 1 and 2 showing multiple embodiments of the curb apparatus 1 being selectively affixed to metal bollard 2, mail drop box 4 and lighted bollard 3 and mounted on curb 7. A 'rail' embodiment is depicted in FIG. 2 with the feet of bench 4 being affixed to two of curb apparatus 1's being connected by a tubular rail 6 in curb 7. FIGS. 3 and 4 showing top and bottom perspective views of the invention respectively. The preferred embodiment of the L-shaped curb apparatus comprised of a planar, rectangular, horizontal plate 15 with a vertical portion 16 on a distal end and being made of a rigid material such as steel and the like with apertures for fasteners 8. Users can mount street fixtures to curb apparatus 1's horizontal plate 15 by drilling holes and inserting fasteners into the street features and then into said horizontal plate 15. The figures showing the rail embodiment having rectangular, hollow portions 11 receiving rail 6 there between and a 'bottom bracket' embodiment with L-shaped bracket 10 having apertures to affix curb apparatus 1 to the flat portion of a curb gutter. FIG. 5 showing a section view of curb apparatus 1 anchoring steel bollard 2 to curb 7 by means of fasteners 8. These fasteners may include but not be limited to standard bolts, carriage bolts, anchor rods and the like. FIG. 6 showing a section view of invention 1 anchoring steel bollard 2 to curb 7 by means of adhesive 9 which may include but not be limited to polyurethane, epoxies and the like. Other embodiments may not have any anchoring methods and simply rely on the weight of the street feature in combination with the curb for support. FIGS. 7 and 8 showing multiple embodiments of the curb apparatus 1 having triangular-shaped gusset plates 14 providing additional support to prevent the bending of the horizontal plate 15 and vertical portion 16. FIG. 8 showing stiffener members 14 being configured along the longitudinal axis of curb apparatus 1 and positioned inside grooves created in sidewalks and the like to prevent lateral shifting. Finally, the figures showing a clamp embodiment whereby street feature base plate 12 is selectively secured to the curb apparatus 1 by means of plate clamps 13 and bolts 8 secured thereon. Said gusset plates 14 and stiffener members 14 being made of a rigid material such as metal and the like and being welded to said curb apparatus 1.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the scope of the invention.

What is claimed is:

1. A curb apparatus for anchoring a street feature to a street curb, the curb apparatus consisting of:

(a) a horizontal plate for mounting the street feature to the curb apparatus, wherein the horizontal plate is planar and configured to be substantially parallel to the street curb when in an installed condition, wherein the horizontal plate has a first side and a second side opposite the first side, and wherein the horizontal plate has a first end and a second end opposite the first end;

(b) a vertical portion connected between the first end and the second end of the horizontal plate, wherein the vertical portion connects to the second side of said horizontal portion proximate said first end so that a first portion of the second side of the horizontal plate extends between a first surface of the vertical portion and the first end of the horizontal plate and a second portion of the second side of the horizontal plate extends between a second surface of the vertical portion and the second end of the horizontal plate, wherein the vertical portion extends perpendicularly to the horizontal plate, and wherein the vertical portion consists of a plurality of apertures; and (c) a plurality of fasteners, wherein the fasteners enter respective ones of the apertures for securing the vertical portion to the street curb, wherein the horizontal plate further comprises a plurality of gusset plates, wherein the plurality of gusset plates extends from the second side of the horizontal plate between the vertical portion and the second end of the horizontal plate, wherein the first side of the horizontal plate receives the street feature, the street feature being a bollard, and wherein the plurality of gusset plates restricts lateral movement and bending of the horizontal plate, and the gusset plates are configured to be received in respective grooves created in the street curb.

2. A method of anchoring a street feature to a street curb, the method consisting of the steps of:

(a) mounting the street feature to a horizontal plate of a curb apparatus, the horizontal plate being planar and substantially parallel to the street curb, the horizontal plate having a first side and a second side opposite the first side, the horizontal plate having a first end and a second end opposite the first end, the first side of the horizontal plate configured for receiving the street feature, the street feature being a bollard;

(b) positioning the curb apparatus on the street curb by attaching a vertical portion of the curb apparatus to the street curb, the vertical portion being connected to the second side of said horizontal portion proximate said first end so that a first portion of the second side of the horizontal plate extends between a first surface of the vertical portion and the first end of the horizontal plate and a second portion of the second side of the horizontal plate extends between a second surface of the vertical portion and the second end of the horizontal plate;

(c) anchoring the curb apparatus to the street curb by fastening the vertical portion of the curb apparatus to the street curb by inserting a plurality of fasteners through a respective plurality of apertures in the vertical portion; and (d) providing a plurality of gusset plates extending from the second side of the horizontal plate, the plurality of gusset plates configured for restricting lateral movement and bending of the horizontal plate, the gusset plates being configured to be received in respective grooves created in the street curb.

* * * * *